US010051908B2

(12) United States Patent
Redpath et al.

(10) Patent No.: US 10,051,908 B2
(45) Date of Patent: Aug. 21, 2018

(54) HELMET-MOUNTED DISPLAY

(75) Inventors: David Redpath, Beaconsfield (CA); Marie-Pierre Gendron, Mercier (CA); Stéphane Lebel, St. Redempteur (CA); Dominic Giroux Bernier, Montreal (CA); Lindsay Faye Slater, Montreal (CA)

(73) Assignee: Revision Military S.a.r.L., Luxembourg (LU)

( * ) Notice: Subject to any disclaimer, the term of this patent is extended or adjusted under 35 U.S.C. 154(b) by 807 days.

(21) Appl. No.: 13/536,953

(22) Filed: Jun. 28, 2012

(65) Prior Publication Data

US 2014/0000014 A1 Jan. 2, 2014

(51) Int. Cl.
*A42B 3/04* (2006.01)

(52) U.S. Cl.
CPC ..... *A42B 3/04* (2013.01); *A42B 3/042* (2013.01)

(58) Field of Classification Search
CPC ..... A42B 3/04; A42B 3/042; A42B 3/0406; A42B 3/0426; A42B 3/0433; A42B 3/044; A42B 3/30; G02B 23/12
USPC ..... 2/422; 359/630
See application file for complete search history.

(56) References Cited

U.S. PATENT DOCUMENTS 2,442,736 A 6/1948 Valentine
3,461,463 A * 8/1969 Beguin ..... A42B 3/166 2/209
3,889,190 A * 6/1975 Palmer ..... A42B 3/30 2/422
4,490,012 A 12/1984 Magiske
4,798,454 A 1/1989 Hyun
4,974,954 A 12/1990 Muller
5,076,701 A 12/1991 Greenlaw
5,331,459 A * 7/1994 Dor ..... G02B 23/125 359/409
5,331,684 A * 7/1994 Baril ..... A42B 3/04 2/422
5,416,922 A * 5/1995 Horvat ..... A42B 3/042 2/422
5,467,479 A * 11/1995 Mattes ..... G02B 23/125 2/422
5,471,678 A * 12/1995 Dor ..... A42B 3/042 2/422
5,506,730 A * 4/1996 Morley ..... A42B 3/04 2/422
5,581,806 A * 12/1996 Capdepuy ..... A42B 3/04 2/422

(Continued)

FOREIGN PATENT DOCUMENTS

WO WO 2010/045141 A1 4/2010

OTHER PUBLICATIONS

U.S. Appl. No. 14/955,002, filed Nov. 30, 2015.

*Primary Examiner* — Alissa L Hoey
(74) *Attorney, Agent, or Firm* — Wolf, Greenfield & Sacks, P.C.

(57) ABSTRACT

Helmet-mounted display unit arrangements provide improved adjustability, including pitch, yaw, and/or vertical translation adjustment. In some embodiments, adjustments to one parameter do not affect the adjustability of other parameters. The helmet-mounted display and associated mount may be arranged such that the helmet-mounted display fits behind a helmet-mounted visor and/or in front of glasses being worn by the user.

26 Claims, 9 Drawing Sheets

(56) References Cited

U.S. PATENT DOCUMENTS 6,016,160 A * 1/2000 Coombs ..... A42B 3/042 348/61
6,052,832 A * 4/2000 Crompton ..... A42B 3/0426 2/422
6,472,776 B1 * 10/2002 Soto ..... A42B 3/04 307/400
6,662,370 B1 * 12/2003 Buchanan, Jr. ..... A42B 3/04 2/422
7,028,961 B1 * 4/2006 Dittmer ..... F16M 11/04 248/278.1
7,063,427 B1 6/2006 Cutler
7,219,370 B1 * 5/2007 Teetzel ..... A42B 3/04 2/422
7,546,994 B2 * 6/2009 Altonji ..... F16M 11/04 248/276.1
8,120,857 B2 2/2012 Hedges et al.
8,166,575 B2 * 5/2012 Haselmayer ..... A42B 3/166 2/10
8,209,780 B1 * 7/2012 Lemire ..... A42B 3/04 2/422
8,506,100 B2 8/2013 Prendamano
9,033,726 B2 * 5/2015 Bandy ..... G02B 27/017 439/372
9,116,355 B2 * 8/2015 Teetzel ..... G02B 23/18
2002/0120979 A1 * 9/2002 Prendergast ..... A42B 3/04 2/422
2002/0148032 A1 * 10/2002 Basson ..... A42B 3/042 2/422
2004/0181855 A1 * 9/2004 Prendergast ..... G02B 23/125 2/422
2004/0244099 A1 * 12/2004 Prendergast ..... G02B 23/125 2/422
2005/0099015 A1 * 5/2005 Ambs ..... F16B 5/02 292/127
2006/0007562 A1 * 1/2006 Willey ..... A42B 3/042 359/811
2006/0022102 A1 * 2/2006 Dittmer ..... F16M 11/02 248/276.1
2006/0037125 A1 * 2/2006 McDowell ..... A42B 1/247 2/209.13
2006/0048286 A1 * 3/2006 Donato ..... A42B 3/042 2/422
2006/0143764 A1 * 7/2006 Reed ..... A42B 3/042 2/6.2
2006/0174401 A1 * 8/2006 Prendergast ..... A42B 3/04 2/422
2007/0012830 A1 * 1/2007 Prendergast ..... F16M 11/02 248/200
2007/0067894 A1 * 3/2007 Bourree ..... F41G 1/32 2/422
2007/0114252 A1 * 5/2007 Gruebel ..... A42B 3/04 224/181
2008/0170838 A1 * 7/2008 Teetzel ..... A42B 3/042 386/358
2008/0263752 A1 * 10/2008 Solinsky ..... A42B 3/042 2/422
2008/0272868 A1 * 11/2008 Prendergast ..... A42B 3/042 335/207
2009/0059063 A1 * 3/2009 Gallagher ..... A42B 3/042 348/373
2009/0133178 A1 * 5/2009 Aguero ..... G02B 23/125 2/6.2
2009/0133179 A1 * 5/2009 Aguero ..... A42B 3/042 2/6.3
2009/0323975 A1 * 12/2009 Groesch ..... H04R 1/1091 381/71.1
2010/0083413 A1 * 4/2010 McGovern ..... A42B 3/04 2/6.6
2010/0123961 A1 * 5/2010 Bauer, Jr. ..... A42B 3/0426 359/880
2010/0175172 A1 * 7/2010 Dempsey ..... G02B 23/125 2/422
2010/0180364 A1 * 7/2010 Willey ..... A42B 3/042 2/422
2010/0299814 A1 * 12/2010 Celona ..... G02B 23/125 2/422
2010/0320341 A1 * 12/2010 Baumann ..... B60R 11/0241 248/206.2
2011/0015647 A1 * 1/2011 Salisbury, Jr. ..... B25J 17/0275 606/130
2011/0051273 A1 * 3/2011 Tronvig ..... A61F 9/029 359/876
2011/0099695 A1 * 5/2011 Siviter ..... A42B 3/04 2/422
2011/0145981 A1 * 6/2011 Teetzel ..... A42B 3/04 2/422
2011/0239354 A1 * 10/2011 Celona ..... A42B 3/04 2/422
2011/0289661 A1 * 12/2011 Hammond ..... A42B 3/0433 2/422
2011/0314594 A1 * 12/2011 Rogers ..... A42B 3/04 2/421
2012/0002046 A1 * 1/2012 Rapoport ..... A42B 3/04 348/143
2012/0120482 A1 5/2012 Hedges et al.
2012/0317706 A1 12/2012 Lebel et al.
2014/0000013 A1 * 1/2014 Redpath ..... A42B 3/04 2/422

* cited by examiner

HELMET-MOUNTED DISPLAY

FEDERALLY SPONSORED RESEARCH

This invention was made with government support under W911QY11C0046 awarded by the Department of Defense. The government has certain rights in the invention.

FIELD

The present invention relates generally to helmet-mounted displays and their use with protective helmets, and more specifically to adjustable helmet-mounted displays.

DISCUSSION OF THE RELATED ART

Protective helmets are commonly worn by first responders and military and law enforcement personnel to protect the head and face from various types of injuries, including impact and ballistic injuries. Depending on situational needs, accessories such as visors are often donned for added protection.

Helmet-mounted display units are used to present visual information to a user, typically in the form of an electronic display screen mounted in front of one eye. The display may show data, images, video, or any other suitable visual information.

SUMMARY

According to one embodiment, a helmet-mounted display unit includes an electronic display and a connector to adjustably connect the display to a helmet. The connector includes an attachment portion to attach the connector to the helmet, a first revolute joint having a first axis of rotation to permit pitch rotation of the display, and a second revolute joint having a second axis of rotation to permit yaw rotation of the display.

According to another embodiment, an apparatus includes a helmet having a rim including a downwardly-facing surface, and a first helmet-mounted display unit mount for removably attaching a helmet-mounted display unit. The mount is accessible for connection of a helmet-mounted display at the downwardly-facing surface of the helmet rim, and the mount includes electrical contacts to contact corresponding electrical contacts in a helmet-mounted display unit.

According to a further embodiment, a helmet-mounted display unit includes an electronic display and a connector to adjustably connect the display to a helmet. The connector includes an attachment portion to attach the connector to the helmet, a first joint having a first axis of rotation to permit changes to a pitch orientation of the display, and a second joint having a second axis of rotation to permit changes to a yaw orientation of the display. Changing the pitch orientation does not change the orientation of the second axis of rotation about which changes to yaw orientation are permitted.

According to yet another embodiment, an apparatus includes a helmet, a visor mounted to the helmet, and an electronic display attached to the helmet in a location where the display is to visible to a wearer of the helmet by at least one eye. When the helmet is worn by the user, the visor is positioned to protect the wearer's eyes, and the display is positioned between the wearer's face and the visor without contacting the visor.

Various embodiments of the present invention provide certain advantages. Not all embodiments of the invention share the same advantages and those that do may not share them under all circumstances. Further features and advantages of the present invention, as well as the structure of various embodiments that incorporate aspects of the invention are described in detail below with reference to the accompanying drawings.

BRIEF DESCRIPTION OF DRAWINGS

The foregoing and other features and advantages of the invention will be appreciated more fully from the following drawings, wherein like reference characters designate like features, in which.

DETAILED DESCRIPTION

Applicants have recognized that helmet-mounted display units often do not provide a user with much flexibility in position and orientation adjustments. Additionally, helmet-mounted display arrangements often prevent the use of a helmet-mounted visor due to the mounting arrangement, unit size, or both. Helmet-mounted display unit arrangements are disclosed herein which provide improved adjustability and modularity of helmet-mounted displays for the user. In some embodiments, the helmet-mounted display unit and associated mount may be arranged such that the helmet-mounted display is usable with a helmet-mounted visor in an operational position and/or while wearing glasses.

Certain embodiments disclosed herein provide helmet-mounted display unit arrangements which provide improved adjustability, including pitch, yaw, and/or vertical translation adjustment. A helmet is provided in some embodiments with two mounts so that the user can choose which eye to use to view the helmet-mounted display. In some embodiments, the helmet-mounted display is rotatable out of the line of sight of the user when not in use. The helmet-mounted display and associated mount may be arranged such that the helmet-mounted display fits behind a helmet-mounted visor and/or in front of glasses being worn by the user.

Figure 1:
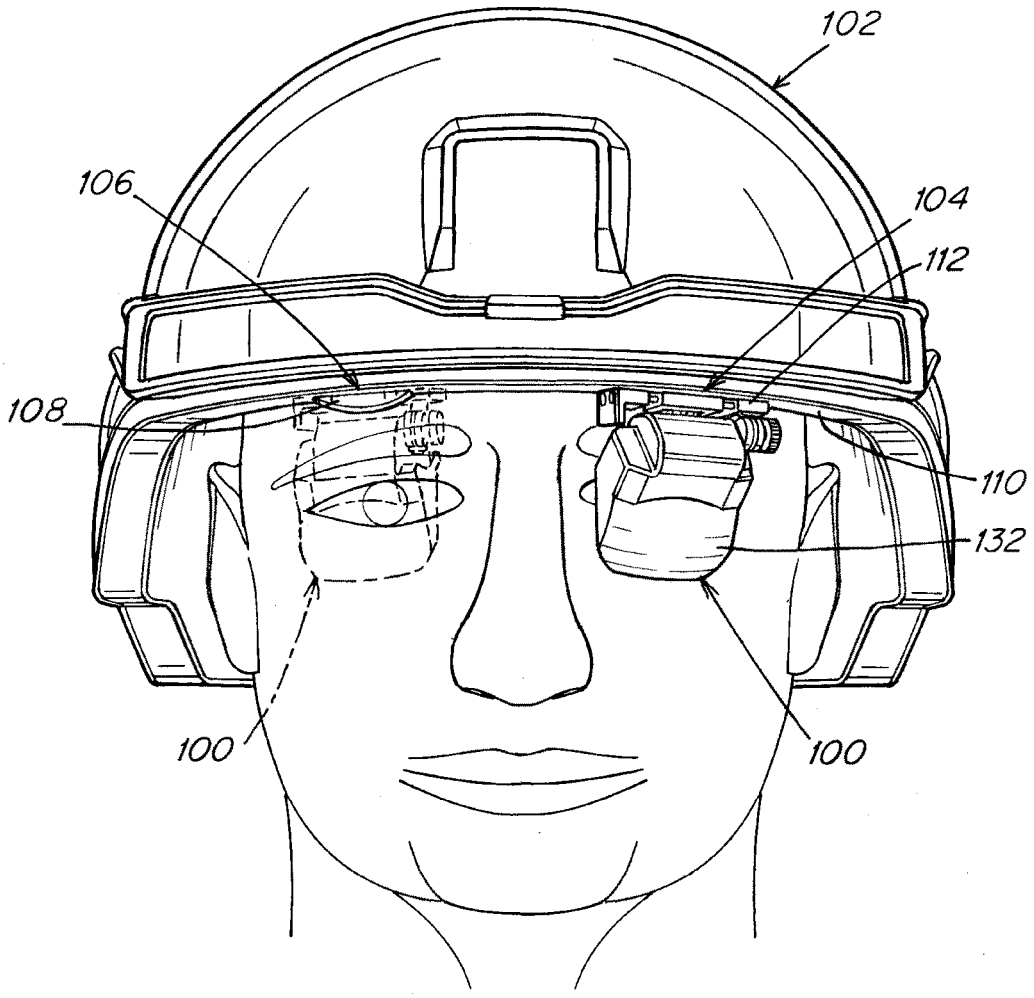
FIG. 1 shows a helmet-mounted display unit mounted to a helmet according to one embodiment.

One embodiment of a helmet-mounted display 100 attached to a helmet 102 is shown in FIG. 1. Helmet-mounted display 100 is shown mounted in front of a user's left eye at a first mount location 104, but the helmet-mounted display instead may be mounted in front of the user's right eye using a separate mount location 106, as shown in phantom. A cover 108 is shown covering a mount at mounting location 106 to protect the mount when not in use.

Helmet-mounted display 100 is attached to helmet 102 at a downwardly-facing surface of an edge trim 110 which runs along a rim of the helmet. In some embodiments, the edge trim 110 may be an edge halo as shown in FIG. 1. In addition to convenience of attachment and removal, such a mount location and arrangement permits the use of a helmet-mounted visor and/or glasses by the user while simultaneously using the helmet-mounted display, as will be discussed further below with reference to FIGS. 10 and 11.

Figure 2:
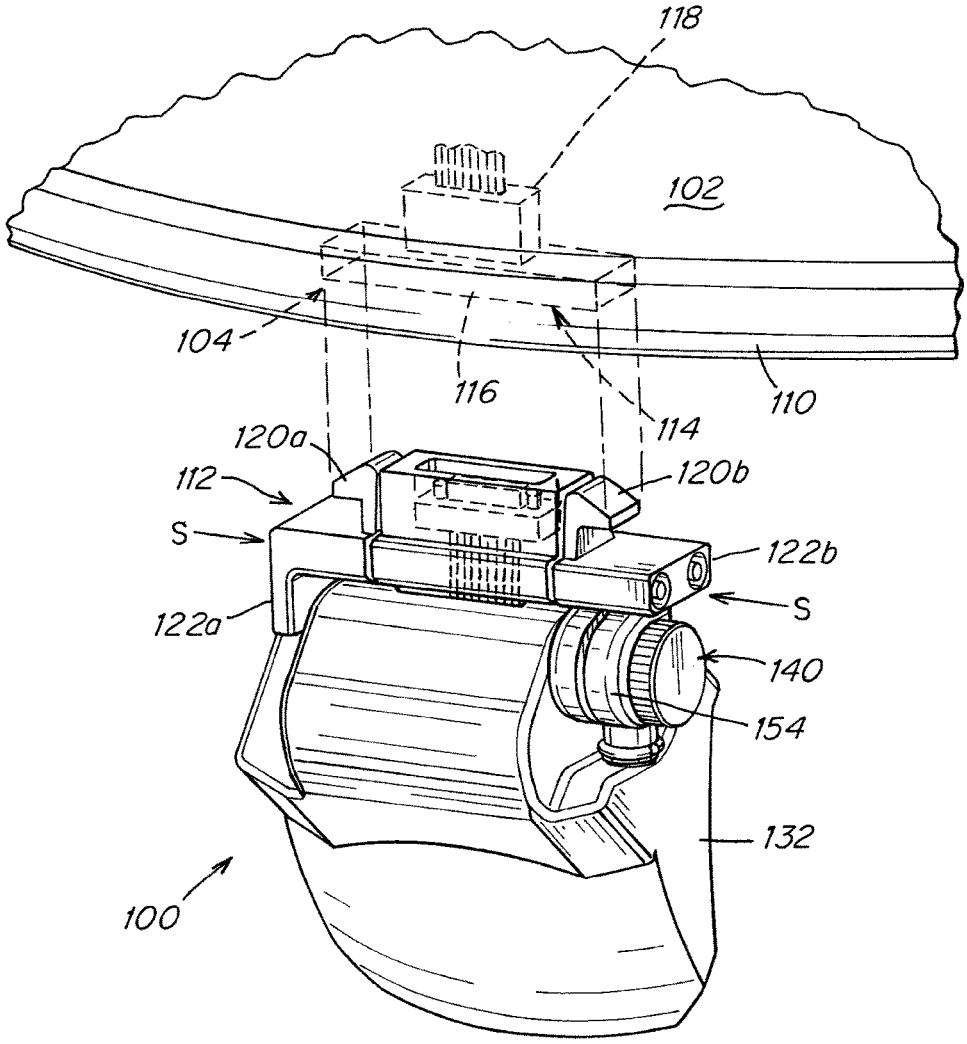
FIG. 2 is a perspective view of a helmet-mounted display unit with an attachment portion arranged to attach the helmet-mounted display to a helmet according to one embodiment.

One particular arrangement for removably attaching helmet-mounted display 100 at mounting location 104 is shown in FIG. 2. Helmet-mounted display includes a connector 112 which is removably attachable to a mount 114. In this embodiment, mount 114 includes an opening 116 in edge trim 110 of the helmet, and also includes an electrical connector 118.

Connector 112 includes an attachment portion with two spring-biased catches 120*a*, 120*b* which can be collapsed toward each other by a user's grip on squeeze grip locations 122*a*, 122*b*, the grip compressing a springs 124 as indicated by arrows S in FIG. 2. The collapsed catches fit into opening 116, and when released, expand to engage interior surfaces located to the side of opening 116. Similarly, to remove the unit, catches 120*a* and 120*b* are squeezed toward each other, and helmet-mounted display unit 100 is removed from opening 116. Using such an arrangement, helmet-mounted display unit 100 is attachable and removable from the helmet without the use of tools. The width of edge trim 110 may be one inch or less in some embodiments, and opening 116 may have a width of approximately half an inch or less. In some embodiments, the width of edge trim 110 is approximately 12 mm, and the opening has a width of 5 mm and a length of 30 mm.

Electrical connector 118 may contain power and data contacts, and is a pin or socket connector in some embodiments. The connection with a corresponding socket or pin connector on connector 112 may provide an additional physical attachment in some embodiments. In some embodiments, the pin and socket connectors may include a threaded connection to physically connect helmet-mounted display 100 to helmet 102. Of course any suitable electric connection may be used in various embodiments. In certain embodiments, no electrical connection may be needed. For example, helmet-mounted display unit 100 may receive signals wirelessly and contain its own power supply, obviating the need for an electrical connection to the helmet.

Mounting locations 104 and 106 may be positioned such that a horizontal center of a display is positioned laterally of a front-to-back centerline of the user's head by a distance of 32 mm in some embodiments. Of course other mounting positions may be used in various embodiments, and may be determined based on intended use of the helmet-mounted display, and/or averages/distributions of a population's pupil distances from the front-to-back centerline of their heads.

Figure 3:
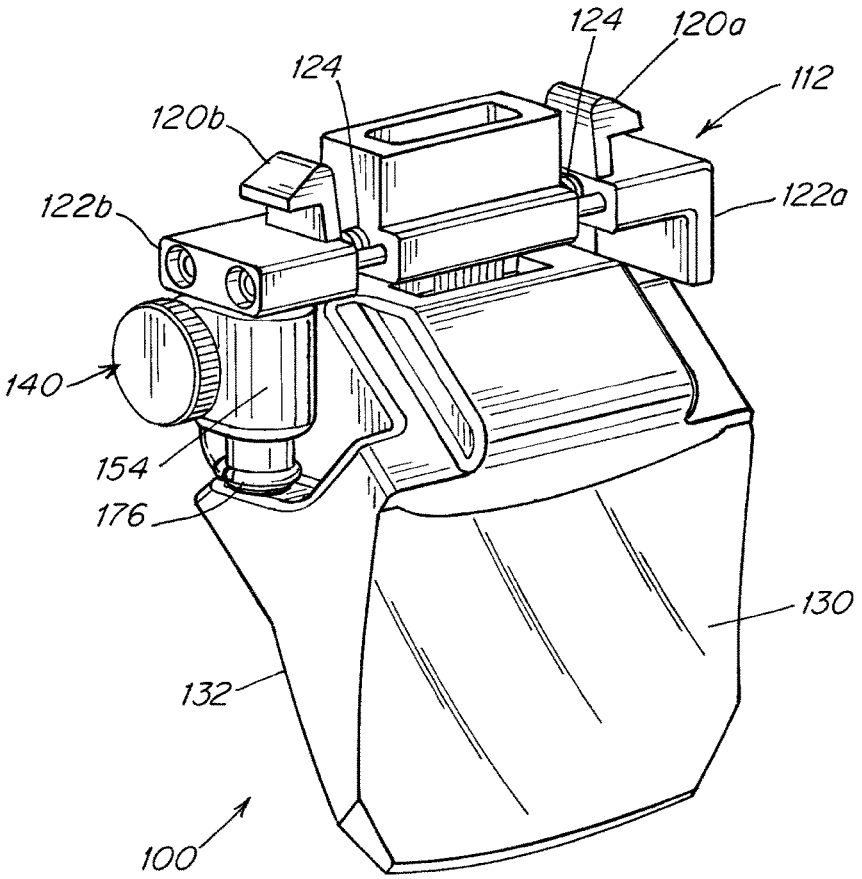
FIG. 3 is a perspective of the display side of a helmet-mounted display unit according to one embodiment.

The display side of helmet-mounted display 100 is shown in FIG. 3. An electronic display 130 is held within a display housing 132. In some embodiments, no display housing is present, and display 130 is instead directly connected to the attachment portion of connector 112. Display 130 may be any suitable type of electronic display, including a projector projecting VGA or High Definition images onto a surface. An LCD or plasma screen may be used in some embodiments. Any type of display requiring electrical power, even if used intermittently, is considered an electronic display for purposes herein. For example, a display using electrophoretic ink may be used in some embodiments. Images, videos, maps, data, or any other suitable types of information may be displayed on display 130. Typically, data is transferred to the helmet-mounted display from an input cable mounted to the helmet. The input cable may be attached to any of a number of suitable devices to receive data. As mentioned above, in some embodiments wireless transmission of data may be used to transmit data to display 130.

Once mounted to the helmet, adjustments to pitch and yaw orientation of the display are permitted in some embodiments to allow the user to place the display in a desired orientation relative to his or her line of sight (LOS). Vertical adjustability of the display height also may be provided. Adjustments to each of these three parameters can be performed independently of one another in some embodiments.

Figure 4:
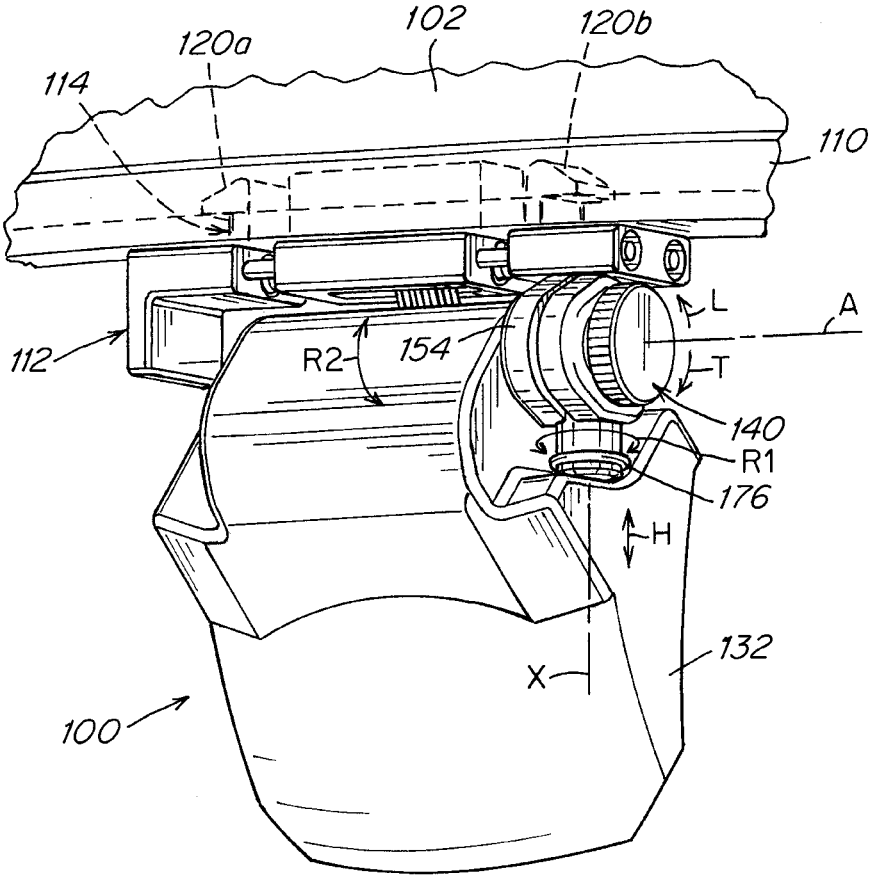
FIG. 4 is a perspective view of helmet-mounted display unit fastened to a helmet and showing the degrees of freedom of the helmet-mounted display unit according to one embodiment.
Figure 5:
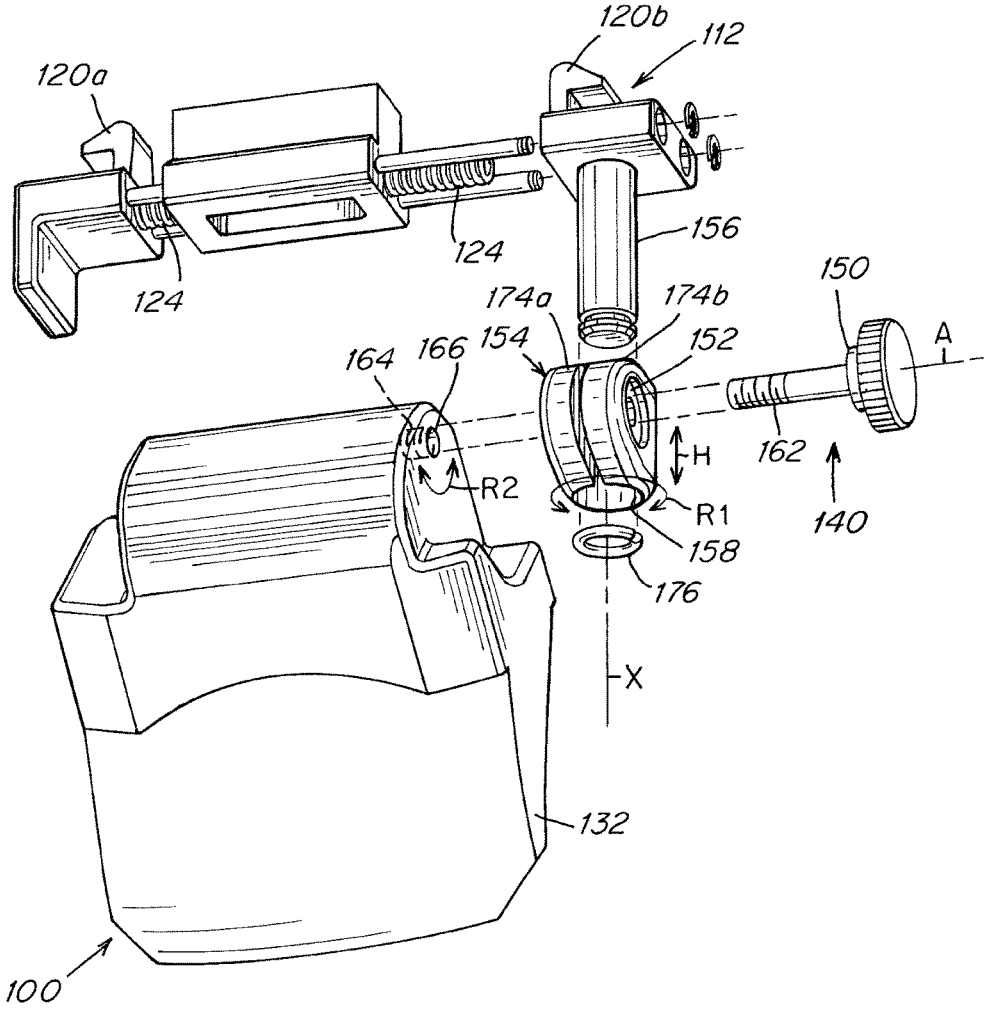
FIG. 5 is an exploded view of the helmet-mounted display unit illustrated in FIG. 4 according to one embodiment.

One particular configuration of connector 112 which provides these features is shown in FIGS. 4 and 5. Adjustments to the yaw orientation are produced by rotating display housing 132 about a substantially vertical axis X as shown by arrow $R_1$. Rotation about a substantially horizontal axis A provides pitch adjustment as shown by arrow $R_2$. The vertical position of display housing 132 (and thus display 130) is adjustable along axis X as shown by arrow H. The direction of arrow H, which corresponds to a movement direction of the display along the direction of axis X, is different from a direction of arrow S shown in FIG. 2, which corresponds to a movement direction of the spring-based catches 120*a*, 120*b*.

According to one aspect, the second joint is distinct from the attachment portion such that linear movement of the display along the direction of axis X occurs independently of the attachment portion fastening the connector to the helmet.

To permit the rotations and translation described above, a tightening bolt 140 is rotatable in a loosening direction L. When loosened, openings may be rotated about pins to provide angular adjustment, and an opening may be moved along a pin in a sliding motion to provide vertical translation. To lock a particular position/orientation, tightening bolt 140 is rotated in a tightening direction T to create sufficient friction between various surfaces to prevent rotation and/or movement.

An exploded view of connector 112 shows the arrangement of parts in detail according to one embodiment. A first revolute joint is formed with a short pin section or shoulder 150 inserted in a cylindrical opening 152 in a connector clamp 154. Pin 150 may be rotated relative to opening 152 in either direction about a substantially horizontal axis A (see arrow R.sub.2) to provide pitch adjustments. A second revolute joint is formed by a pin 156 positioned in a cylindrical opening 158. Rotation of connector clamp 154 about pin 156 adjusts the yaw orientation of display housing 132 (see arrow R.sub.1). Pin 156 and opening 158 may provide a cylindrical joint by additionally allowing vertical translation of connector clamp 154 relative to pin 156 along axis X (see arrow H). As a result, the display is movable in pure linear translation along axis X.

According to one aspect, a movement direction of a fastener portion of the attachment portion from the first orientation to the second orientation is different from a movement direction of the display along the direction of axis X.

As mentioned above, locking of rotation and translation provided by these joints is achieved by turning tightening bolt such that a threaded section 162 of tightening bolt 140 engages a threaded section 164 of opening 166. Bolt 140 may be tightened to an extent such that a face of short pin section or shoulder 150 engages connector clamp 154 and squeezes forks 174*a*, 174*b* against pin 156 with sufficient force to frictionally prevent rotation and translation around and along axis X. Shoulder 150 also presses connector clamp 154 against housing 132 to frictionally prevent rotation about axis A. In this configuration, the position and orientation of the display is locked.

According to one aspect, the clamp is engageable to lock the display in a first pitch orientation and in a second, different pitch orientation.

To permit orientation and position adjustment, tightening bolt 140 is loosened by the user, and the revolute joint and/or cylindrical joint are free to rotate and/or translate. In some embodiments, a partially engaged configuration is possible, wherein tightening bolt 140 is engaged to an extent where adequate friction is present to prevent rotation and/or translation that might otherwise occur due to gravity and/or expected typical helmet or head movements, yet intentional forces applied by the user's hand can overcome the friction to rotate and/or move the display housing. In this manner, one hand adjustment of the display may be facilitated.

The arrangement of joints on connector 112 permits pitch angle adjustment without affecting yaw angle adjustment in some embodiments. For example, when display housing 132 is rotated about axis A to change pitch angle, the orientation (and location) of axis X is not changed. Accordingly, changes to pitch do not necessarily affect yaw angle adjustability. In conventional ball and socket connectors, pitch adjustments change the orientation of the yaw axis of rotation.

A clip ring 176 or other component(s) is provided near an end of pin 156 to keep connector clamp 154 on pin 156 in some embodiments.

Figure 12:
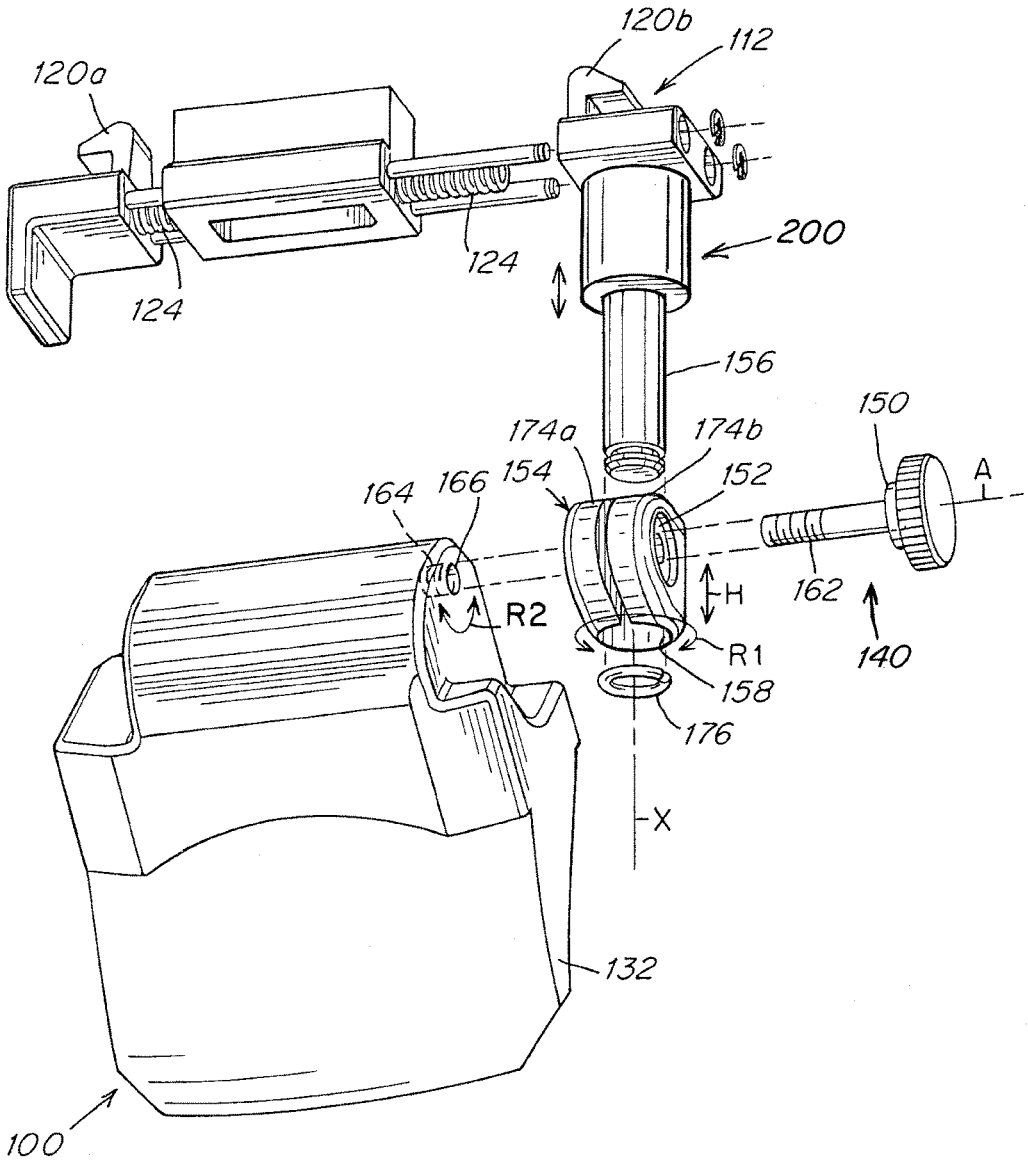
FIG. 12 is an exploded view of a helmet-mounted display unit having a revolute joint and a separate prismatic joint according to another embodiment.

While pin 156 and opening 158 may form a cylindrical joint, in some embodiments, such as the illustrative embodiment shown in FIG. 12, a separate prismatic joint 200 may be included to provide vertical translation, while pin 156 and opening 158 form only a revolute joint for yaw adjustment. Prismatic joints do not require cylindrical pins and/or cylindrical openings. In some embodiments, cross-sectional shapes of a prismatic joint pin may be selected to prevent rotation, thereby permitting only translational movement.

Horizontal adjustment may be provided in some embodiments by providing a cylindrical joint that allows translation along axis A, or by providing a separate prismatic joint that allows horizontal translation.

The embodiment illustrated in FIGS. 4-5 is exemplary, and other embodiments which provide pitch, yaw, and/or position adjustment(s) may be used. For example, in some embodiments, multiple tightening bolts may be used, and actuators other than tightening bolts may be used to lock the position and orientation of the display.

Figure 6:
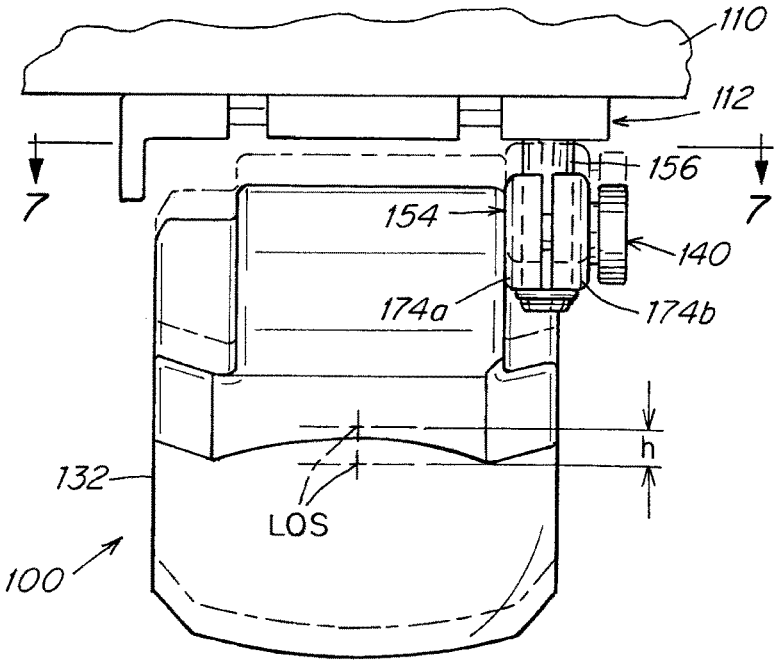
FIG. 6 is a front view of the helmet-mounted display unit attached to a helmet showing two vertical positions according to one embodiment.

A highest and lowest vertical adjustment setting for one embodiment of a helmet-mounted display 100 is shown in FIG. 6. The user may adjust the vertical position of helmet-mounted display 100 to either the highest setting (shown in phantom), the lowest setting (shown in solid lines), or any setting in between depending on the user's preferences and the location of his or her line of sight (LOS). The distance h between the two settings is 14 mm in some embodiments, though any suitable difference in the highest and lowest setting may be used. For example, differences of between 10 mm and 20 mm may be used.

In the embodiment shown in FIGS. 4-6, the vertical position may be adjusted to any height between and including the highest and lowest settings along a continuum, while in other embodiments, certain intervals of heights may be defined such that a limited selection of height settings are available. For example, a vertical height locking arrangement may include a spring biased catch that inserts itself into one of a number of spaced grooves along a pin. The user retracts the catch, slides a cylindrical opening along the pin, releases the catch at or near a suitable position, and then continues to slide the opening slowly until the pin inserts itself into a groove.

Figure 7:
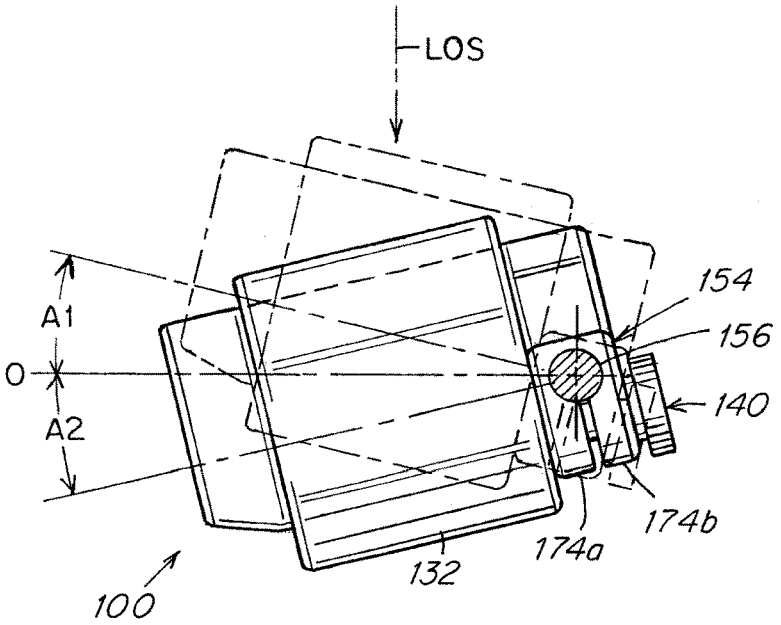
FIG. 7 is a cross-sectional top view of the helmet-mounted display unit taken along line 7-7 of FIG. 6 showing two yaw orientations according to one embodiment.

FIG. 7 shows two yaw adjustment orientations with a top cross-sectional view of display housing 132. A neutral yaw angle orientation is shown in phantom. A clockwise yaw angle orientation $A_1$ is shown in phantom lines and a counterclockwise yaw angle orientation $A_2$ is shown in solid lines. In the illustrated embodiment, the yaw angle adjustments are typically made up to an adjustment of 13.5 degrees (see $A_1$ and $A_2$). In some embodiments, limits to yaw angle adjustments may be provided by components of the connector, and angles $A_1$ and $A_2$ may be different from one another. Further, certain embodiments may not permit yaw angle adjustment at all, and instead allow only pitch angle adjustments, horizontal position adjustment, and/or vertical position adjustment.

Figure 8:
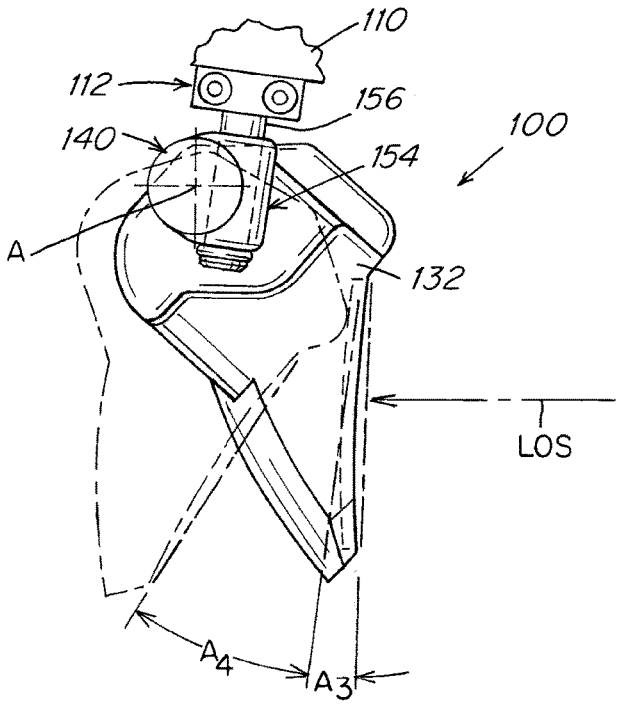
FIG. 8 is a side view of the helmet-mounted display unit showing two pitch orientations according to one embodiment.

The side view of FIG. 8 shows two pitch angle adjustment positions. An "upward" pitch angle $A_4$ position is shown in phantom, while a "downward" pitch angle $A_3$ position is shown in solid lines. Angles $A_3$ and $A_4$ represent the typical working range of pitch adjustment in some embodiments, while in other embodiments, angles $A_3$ and $A_4$ represent limits of pitch adjustment as dictated by components of the connector. $A_3$ is shown five degrees and $A_4$ is shown twenty-five degrees in the illustrated embodiment. Of course other limits and/or working ranges of pitch angle adjustments may be used. As discussed above with respect to yaw adjustment, the pitch adjustment may be adjustable along a continuum, or a stepwise adjustment scheme may be used.

Figure 9:
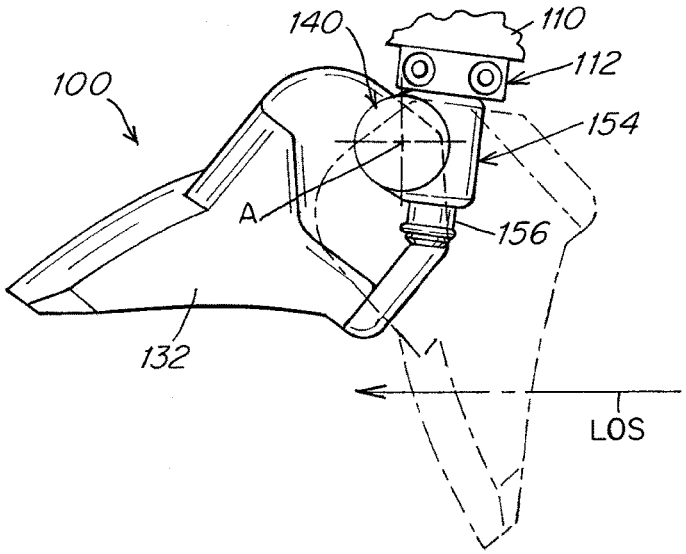
FIG. 9 is a side view of the helmet-mounted display unit showing the unit pitched in a direction away from the helmet in a non-use position according to one embodiment.

In some embodiments, an upward pitch adjustment of eighty degrees or more is possible to remove the helmet-mounted display from the user's line of sight LOS (see FIG. 9). Certain embodiments may not permit pitch angle adjustment at all, and instead allow only yaw angle adjustments, horizontal position adjustment, and/or vertical position adjustment.

It is important to note that while pitch angle adjustment generally occurs by rotation about an axis of rotation that is substantially horizontal, the axis of rotation is not required to be strictly horizontal or substantially horizontal in some embodiments. For example, the connector may provide an axis of rotation that is slanted thirty degrees from horizontal, yet still may provide a pitch adjustment component when the display is rotated about the axis. Similarly, while yaw angle adjustment generally occurs via rotation about an axis of rotation that is substantially vertical, the axis of rotation is not require to be strictly vertical or substantially vertical in some embodiments.

Figure 10:
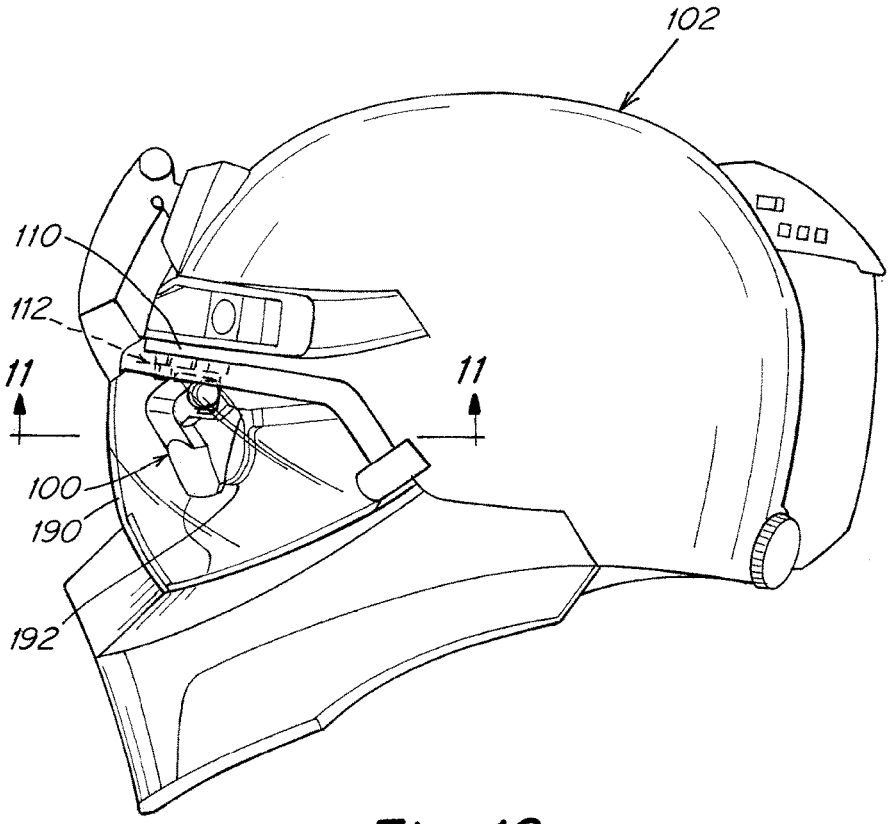
FIG. 10 is a side view of a helmet-mounted display unit mounted to a helmet and positioned behind a visor according to one embodiment.
Figure 11:
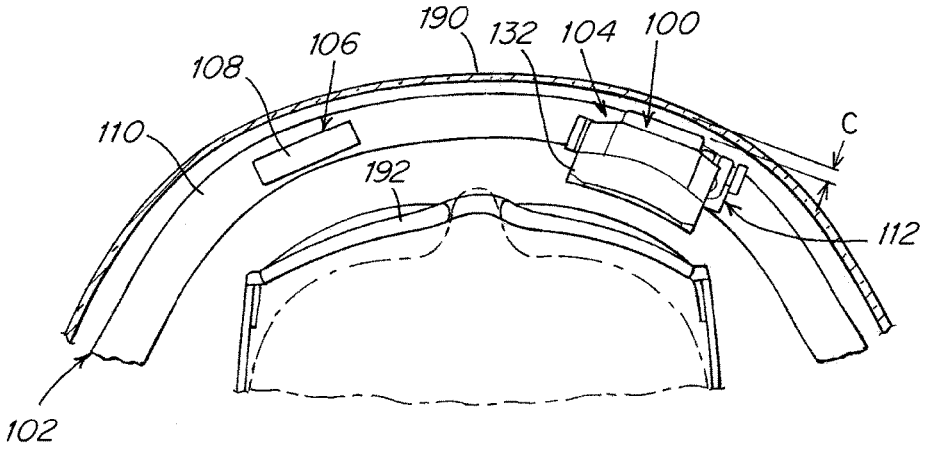
FIG. 11 is a bottom, partial cross-sectional view of the helmet-mounted display unit arrangement taken along line 11-11 of FIG. 10.

According to some embodiments, the mounting position and size of the helmet-mounted display permits a user to use the helmet-mounted display while a helmet-mounted visor is in a protective arrangement. For example, as illustrated in FIGS. 10 and 11, helmet-mounted display 100 is mounted to helmet 102 on the underside of edge trim 110. A movable helmet-mounted visor 190 can be placed in front of the user's face without contacting the helmet-mounted display. To adjust the position and/or orientation of helmet-mounted display 100, the user may lift visor 190. The helmet-mounted display also may be positioned sufficiently distant from the user's eye such that glasses such as protective glasses 192 may be worn by the user as well without contacting the helmet-mounted display. In this manner, the helmet-mounted display may be positioned between a helmet-mounted visor and protective glasses while in use. In some embodiments, the display screen is approximately 1 inch from the user's eye. A clearance C between the visor and the helmet-mounted display may be small in some embodiments, e.g., on the order of a few millimeters.

It should be appreciated that various embodiments of the present invention may be formed with one or more of the above-described features. The above aspects and features of the invention may be employed in any suitable combination as the present invention is not limited in this respect. It should also be appreciated that the drawings illustrate various components and features which may be incorporated into various embodiments of the present invention. For simplification, some of the drawings may illustrate more than one optional feature or component. However, the present invention is not limited to the specific embodiments disclosed in the drawings. It should be recognized that the present invention encompasses embodiments which may include only a portion of the components illustrated in any one drawing figure, and/or may also encompass embodiments combining components illustrated in multiple different drawing figures.

It should be understood that the foregoing description of various embodiments of the invention are intended merely to be illustrative thereof and that other embodiments, modifications, and equivalents of the invention are within the scope of the invention recited in the claims appended hereto.

What is claimed is:

1. A helmet-mountable display unit comprising:

an electronic display;

a connector to adjustably connect the display to a helmet, the connector including:

an attachment portion that fastens the connector to the helmet;

a first joint having a first axis of rotation to permit pitch rotation of the display; and a second joint having a second axis of rotation to permit yaw rotation of the display, wherein the display is linearly movable along a direction of the second axis of rotation, the second joint and the attachment portion being two different components, and linear movement of the display along the direction of the second axis of rotation occurring independently of the attachment portion fastening the connector to the helmet.

2. The helmet-mountable display unit according to claim 1, wherein the second joint comprises a revolute joint and the connector further comprises a prismatic joint to permit translation of the display.

3. The helmet-mountable display unit according to claim 2, wherein the first axis of rotation is horizontal, the second axis of rotation is vertical, and the prismatic joint permits vertical translation of the display.

4. The helmet-mountable display unit according to claim 2, further comprising a clamp that frictionally engages with the first joint and the second joint to prevent yaw rotation, pitch rotation, and vertical translation of the display when the clamp is engaged by a clamp actuator.

5. The helmet-mountable display unit according to claim 1, wherein the second joint comprises a cylindrical joint.

6. The helmet-mountable display unit according to claim 1, wherein the attachment portion comprises a spring-biased catch.

7. The helmet-mountable display unit according to claim 1, further comprising electrical contacts to electrically connect the helmet-mounted display unit to corresponding electrical contacts of the helmet.

8. The helmet-mountable display unit according to claim 7, wherein one of a pin connector and a socket connector include the electrical contacts.

9. The helmet-mountable display unit according to claim 1, wherein the second joint permits yaw rotation of the display of at least 13.5 degrees in each direction.

10. The helmet-mountable display unit according to claim 1, wherein the first joint permits pitch rotation of the display of at least eighty degrees in a direction away from the helmet to remove the display from a line of sight of the wearer.

11. The helmet-mountable display unit according to claim 1, further comprising a display housing, wherein the display is held by the connector via the display housing.

12. The helmet-mountable display unit according to claim 1, wherein the first joint includes a first pin, the second joint includes a second pin, and the connector includes a pin connector, the pin connector including a first opening in which the first pin rotates, and a second opening in which the second pin rotates.

13. The helmet-mountable display according to claim 12, wherein the first pin is oriented at an angle of approximately ninety degrees relative to the second pin.

14. The helmet-mountable mounted display according to claim 12, wherein the pin connector is slidable vertically along the second pin.

15. The helmet-mountable display unit according to claim 1, wherein the attachment portion is configured to be attached to a helmet opening, the helmet opening having a width of less than a half inch.

16. The helmet-mountable display unit according to claim 1, wherein the attachment portion is configured to be attached to a helmet opening without the use of tools.

17. The helmet-mountable display unit according to claim 1, wherein the attachment portion attaches the connector directly to the helmet.

18. The helmet-mountable display unit according to claim 1, wherein the first joint comprises a revolute joint.

19. The helmet-mountable display unit of claim 1, wherein a position of the second axis of rotation remains stationary while the display moves linearly along the direction of the second axis of rotation.

20. A helmet-mountable display unit comprising:

an electronic display;

a connector to adjustably connect the display to a helmet, the connector including:

an attachment portion to attach the connector to the helmet;

a first joint comprising a revolute joint having a first axis of rotation to permit changes to a pitch orientation of the display;

a second joint having a second axis of rotation to permit changes to a yaw orientation of the display; and a clamp that frictionally engages with the first joint and the second joint to prevent yaw rotation of the display about the second axis of rotation and pitch rotation of the display about the first axis of rotation when the clamp is engaged by a clamp actuator, wherein the clamp is engageable to lock the display in a first pitch orientation and in a second, different pitch orientation, wherein a position of the second axis of rotation of the second joint remains stationary as the pitch orientation of the display changes, and wherein when the display is connected to the helmet and the helmet is worn by the user, the display is configured to be visible to at least one of the wearer's eyes.

21. The helmet-mountable display unit according to claim 20, wherein the connector including the attachment portion is constructed and arranged to attach to a mount positioned on a downwardly-facing surface of a helmet.

22. The helmet-mountable display unit according to claim 20, wherein the clamp actuator comprises a clamp bolt to engage and disengage the clamp.

23. A helmet-mountable display unit comprising:

an electronic display;

a connector to adjustably connect the display to a helmet, the connector including:

an attachment portion having a fastener portion having first and second engagement surfaces, wherein the first engagement surface moves relative to the second engagement surface in a first direction from a first orientation to a second orientation to fasten the connector to the helmet;

a first joint having a first axis of rotation to permit pitch rotation of the display; and a second joint having a second axis of rotation to permit yaw rotation of the display, wherein the display is linearly movable along a direction of the second axis of rotation in a linear sliding direction that is different from the first direction.

24. The helmet-mountable display unit of claim 23, wherein a position of the second axis of rotation remains stationary while the display moves linearly along the direction of the second axis of rotation.

25. A helmet-mountable display unit comprising:

an electronic display;

a connector to adjustably connect the display to a helmet, the connector including:

an attachment portion that fastens the connector to the helmet;

a first joint having a first axis of rotation to permit pitch rotation of the display;

a second joint having a second axis of rotation to permit yaw rotation of the display, wherein the display is linearly movable along a direction of the second axis of rotation, the second joint and the attachment portion being two different components, and linear movement of the display along the direction of the second axis of rotation occurring independently of the attachment portion fastening the connector to the helmet; and electrical contacts to electrically connect the helmet-mounted display unit to corresponding electrical contacts of the helmet.

26. A helmet-mountable display unit comprising:

an electronic display;

a connector to adjustably connect the display to a helmet, the connector including:

an attachment portion that fastens the connector to the helmet;

a first joint having a first axis of rotation to permit pitch rotation of the display; and a second joint having a second axis of rotation to permit yaw rotation of the display, wherein the display is linearly movable along a direction of the second axis of rotation, the second joint and the attachment portion being two different components, and linear movement of the display along the direction of the second axis of rotation occurring independently of the attachment portion fastening the connector to the helmet, wherein the second joint comprises a cylindrical joint, wherein linear movement of the display occurs along the cylindrical joint, and wherein the first axis of rotation is perpendicular to the second axis of rotation.

* * * * *